United States Patent [19]

Matsumoto et al.

[11] 3,934,565

[45] Jan. 27, 1976

[54] CHOKE CONTROL SYSTEM FOR CARBURETORS

[75] Inventors: Hirohumi Matsumoto; Masahiko Nakada, both of Toyota, Japan

[73] Assignee: Toyota Jidosha Kogyo Kabushiki Kaisha, Japan

[22] Filed: June 10, 1974

[21] Appl. No.: 477,979

[30] Foreign Application Priority Data

June 22, 1973 Japan ..... 48-69743

[52] U.S. Cl. ..... 123/119 F; 123/106; 261/39 B; 180/105 R

[51] Int. Cl.² ..... F02M 1/10

[58] Field of Search ..... 123/124 R, 119 F, 97 B, 123/102, 106; 261/39 R, 39 B; 180/105 R

[56] References Cited

UNITED STATES PATENTS

| | | | |
|---|---|---|---|
| 3,167,254 | 1/1965 | Goodyear | 123/119 F |
| 3,431,899 | 3/1969 | Neidhart | 123/97 R |
| 3,520,330 | 7/1970 | Szwargulski | 261/39 B |
| 3,721,222 | 3/1973 | Shioya et al. | 123/124 R |
| 3,800,762 | 4/1974 | McCullough | 261/39 B |

*Primary Examiner*—Wendell E. Burns
*Assistant Examiner*—David Reynolds
*Attorney, Agent, or Firm*—Toren, McGeady and Stanger

[57] ABSTRACT

A mechanism is provided whereby the opening of an automatic choke valve is controlled by means of pressure in a diaphragm chamber with the chamber being selectively communicated with a vacuum pickup tube or an atmospheric pressure pickup tube through operation of a solenoid controlled valve. A switch actuatable in response to vehicle speed and another switch actuatable in response to engine temperature operate to selectively connect the solenoid controlled valve to a power source thereby to determine the operating mode of the valve.

8 Claims, 2 Drawing Figures

CHOKE CONTROL SYSTEM FOR CARBURETORS

BACKGROUND OF THE INVENTION

The present invention relates generally to an automatic choke mechanism for an internal combustion engine, and more particularly to an automatic choke unit which is effective in overcoming exhaust gas pollution problems without adversely affecting stable engine operation during idling or while cruising at a low speed before the engine is sufficiently warmed up.

When an internal combustion engine is cold, insufficient vaporization of fuel is compensated by enriching the fuel-air mixture during the warming-up operation of the engine. The optimum air-fuel ratio which should be provided may vary depending upon changing operating conditions of the engine such as might occur when the engine is operated during starting, idling, cruising at a constant speed, acceleration and the like. An optimum ratio will also be dependent upon surrounding temperature levels and operation of the engine during its warm-up stages. Automatic choke valves have been heretofore used in order to obtain an optimum air-fuel ratio for an engine under various changing operating conditions.

Recently, various improvements have been made in automatic choke systems in order to decrease the time required during warm-up so that operation of the choke valve is required to a lesser extent. As a result, when during the operation of the vehicle the engine has been warmed up to some extent, operation of the choke valve is not required and the choke valve may be opened immediately thereafter.

Conventional automatic choke valves are usually operated by a bimetallic spring member or the like which is responsive to temperatures of the exhaust gases, engine cooling water or an electric heater. Accordingly, it is likely that sufficient engine heat to rapidly open the choke valve may not be obtained. As a result, harmful pollutants such as CO and HC will be discharged from the engine for a relatively long period of time.

In order to overcome these problems, there has been proposed a choke opener mechanism which is adapted for use with an internal combustion engine having improved warming-up characteristics. As in the case of conventional automatic choke valves, the opening of the choke valve is controlled by a diaphragm mechanism which is, in turn, controlled in response to the vacuum of the intake manifold of the engine. The intake manifold pressure changes in response to engine temperature and vehicle speed and, accordingly, a rich fuel-air mixture may be supplied. However, when the vehicle is running after the engine has been warmed up to some extent, the choke valve will be forced to the fully opened position.

Conventional carburetors are usually provided with a fast idle mechanism of the type which cause opening of the throttle valve to an excess degree in response to a small opening of the choke valve so that stable idling may be ensured when the engine has not as yet been sufficiently warmed-up. However, when the choke valve is forced to the fully open position while the vehicle is running, the fast idle mechanism is deactivated before the engine is sufficiently warmed up thereby resulting in unstable engine idling and stalling. Thus, engine operation will be adversely affected.

The present invention is directed to provision of an automatic choke valve having a choke opener mechanism of the type which permits operation of the fast idle mechanism even after the choke opener mechanism has been actuated. In the operation of the present invention, the choke valve may be forcibly opened to a position short of the fully opened position when vehicle speed and engine temperature reach predetermined levels with the choke valve being thereafter moved to the fully opened position by the normal operation of a bimetallic spring member after the engine has been sufficiently warmed-up.

SUMMARY OF THE INVENTION

Briefly, the present invention may be described as an automatic choke system for an automotive vehicle internal combustion engine comprising a choke valve operable between a fully opened and fully closed position, temperature sensitive bimetallic spring means for controlling opening and closing of said choke valve, a choke valve control mechanism adapted to move the choke valve in the direction of opening to a limited position short of the fully opened position but proximate thereto, means for generating a first signal representative of the temperature of the engine, means for generating a second signal representative of the speed of the vehicle, and means for applying both said first and second signals to said control mechanism to cause the choke valve to be opened to said limited position when the temperature of the engine and the speed of the vehicle reach predetermined levels, respectively, said control mechanism being arranged to permit independent operation of the bimetallic means beyond said limited position of said choke valve whereby the choke valve may be moved to the fully opened position by said bimetallic means when the engine has reached a fully warmed-up condition.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
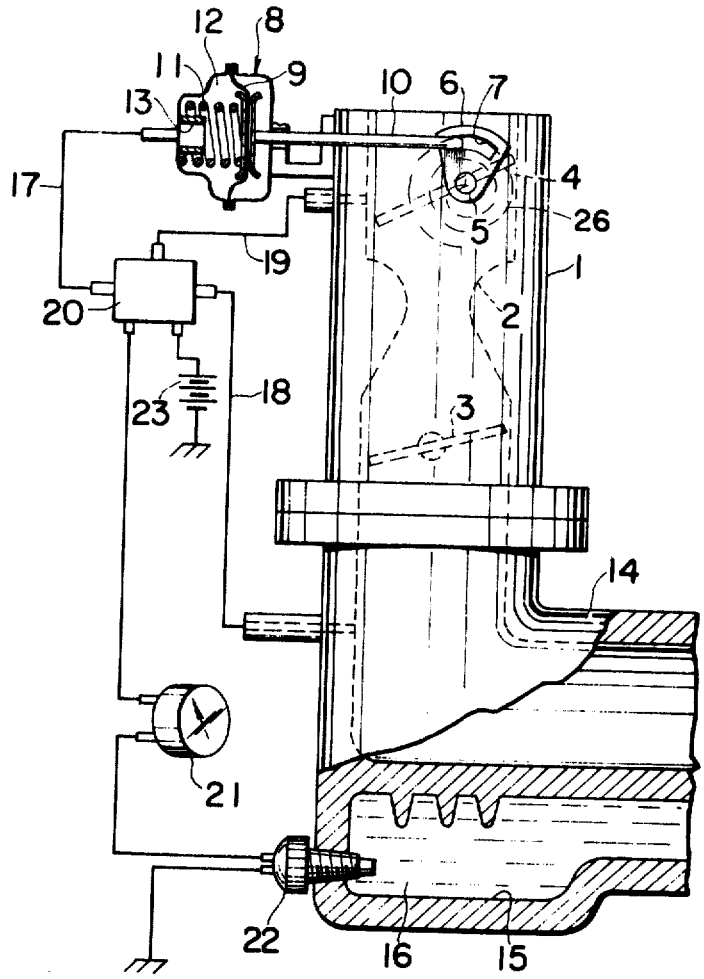
FIG. 1 is a schematic diagram of a device including the automatic choke mechanism of the present invention.

Referring to FIG. 1, a carburetor 1 having a venturi 2 is controlled by operation of a throttle valve 3 and a choke valve 4 which is actuated by a temperature sensitive bimetallic spring member 26, shown schematically in FIG. 1. The choke valve 4 is mounted upon a shaft 5 and a lever 6 operatively coupled to the shaft 5 is arranged to move with the choke valve 4. An elongated slot 7 is formed in the lever 6 and extends concentrically about the shaft 5.

A diaphragm box 8 defining a diaphragm chamber 12 has mounted therein a diaphragm 9 which is connected to one end of a linkage rod 10 with the opposite end of the rod 10 being arranged to extend within the elongated slot 7 of the lever 6. A coiled spring 11 is located within the diaphragm chamber 12 and operates to urge the diaphragm 9 toward the right thereby normally urging the linkage rod 10 toward a position in which its movement is not restrained by the lever 6.

A stopper 13 located within the diaphragm chamber 12 operates to limit leftward movement of the diaphragm 9. Although in the preferred embodiment described herein, the stopper 13 is shown as attached to the diaphragm box 8, it is to be understood that other arrangements may be provided, for example, by affixing the stopper 13 upon the diaphragm 9. Alternatively, in place of the stopper 13, a stopper which limits movement of the linkage rod 10 or of the lever 6 may be provided.

An intake manifold 14 is located adjacent a water jacket 15 formed integrally with the lower side thereof in order to pass cooling water from the engine thereby to warm the intake manifold 14.

The diaphragm chamber 12 is communicated through a pressure line 17 with a vacuum pickup tube 18 or with an atmospheric pressure admission tube 19. A solenoid controlled three-port valve 20 is arranged so that the diaphragm chamber 12 may be selectively communicated either with the negative pressure tube 18 or with the atmosphere pressure tube 19. A preferred embodiment of valve 20 is shown and described on page 3—1 of the Toyota Manual of 1973.

A vehicle speed responsive switch 21 is provided, with the switch 21 being adapted to close when the speed of the vehicle exceeds a predetermined speed, for example, 10 or 20 km/h. Instead of the switch 21, a switch which is actuatable in response to a signal representing the rotational speed of the engine, which in turn represents the speed of the vehicle, may be provided.

A temperature sensitive switch 22 is also provided, with the switch 22 being closed when the temperature of the cooling water 16 rises in excess of a predetermined temperature, for example 20° or 30°C. Instead of the temperature switch 22, there may be provided a switch which is actuatable in response to the temperature of lubricating oil or to the temperature of the wall of the intake manifold 14.

A battery 23 is electrically connected in a series circuit which includes the speed responsive switch 21, the temperature sensitive switch 22 and a solenoid (not shown) of the three-port solenoid valve 20. In the operation of the present invention, when engine warm-up has not been sufficiently achieved and the temperature of the cooling water 16 is low, or the speed of the vehicle is low, the switches 21 and/or 22 will be in the OFF position and, therefore, the solenoid valve 20 will not be energized. Under such conditions, the solenoid valve 20 will interconnect the line 17 with the atmospheric pressure pickup tube 19 so that the diaphragm 9 will be displaced to the right under the force of the spring 11. As a result, the linkage rod 10 will be pushed to the right or in the direction in which the rod 10 will not actuate the lever 6. When this occurs, the end of the rod 10 will move freely within the slot 7 and the choke valve 4 will be controlled only by the bimetallic spring device.

When after a period of operation the engine has become somewhat warmed-up and the temperature of the cooling water rises or the speed of the vehicle is increased, both the switches 21 and 22 are closed to cause the solenoid valve 20 to be energized thereby communicating the line 17 with the negative pressure pickup tube 18 and disconnecting it from the atmospheric pressure pickup tube 19. As a result, negative pressure is transmitted into the diaphragm chamber 12 and the diaphragm 9 is displaced to the left against the force of the spring 11. Accordingly, the linkage rod 10 will be displaced to the left a sufficient distance to cause the end of the rod 10 to engage the end of the slot 7 thereby causing the lever 6 to rotate in a counterclockwise direction. This movement of the lever 6 will cause the choke valve 4 to move toward its opened position. However, the stroke of the diaphragm 9 is limited by the stopper 13 in such a way that the choke valve 4 will not be moved to its fully opened position in response to movement of the diaphragm 9. The choke valve 4 will, therefore, be moved to a limited position short of its fully opened position but proximate thereto. For example, if the angle of the choke valve at its fully opened position, at which the choking effect of the valve is considered to be ineffective, is 70°, the choke valve 4 will be opened to an angle of about 55° by the diaphragm 9 which may be taken to be the limited position to which the valve 4 may be moved by operation of the opening mechanism.

Figure 2:
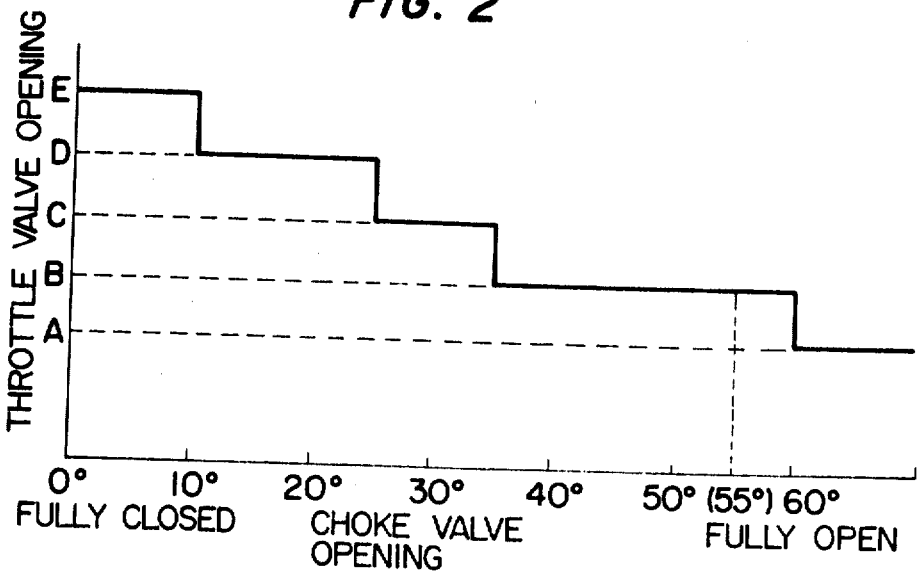
FIG. 2 is a graph showing the relationship between the degree of opening of a choke valve and the opening of a throttle valve in the case of fast idling.

Under these conditions, when the vehicle acceleration pedal is released, the opening of the throttle valve 3 will be at a position indicated by B in FIG. 2 so that the vehicle will be decelerated. With the vehicle stopped and the engine idle, the opening of the throttle valve 3 is greater than the opening A when the engine is idling after it has been warmed up. Therefore, air intake may be sufficiently increased before the engine is warmed-up so that smooth engine performance may be ensured.

In a conventional choke opening mechanism, when the vehicle is decelerated with the choke valve in its fully opened position, the opening of the throttle valve will be at a position labelled A in FIG. 2 when the vehicle is stopped. The opening of the throttle valve is, however, too small for an engine which has not been sufficiently warmed up and unstable idling will occur. However, according to the present invention, the choke valve is not fully opened when the vehicle is running with the engine not sufficiently warmed up. That is, the choke valve is opened only to such an extent where no choking effect is obtained. Thus, a satisfactory counter-measure overcoming increase of pollutants in the exhaust gases may be employed without modifying the conventional fast idling mechanism of the engine and without adversely affecting engine idling before complete engine warm-up is achieved.

After the engine is sufficiently warmed up, the choke valve will be moved to its fully opened position by operation of the bimetallic spring as indicated by A in FIG. 2 so that normal idling may be effected.

As described hereinbefore, in accordance with the automatic choke valve mechanism of the present invention, a satisfactory choking effect may be obtained when an engine is started or is idling, or when the vehicle is operating at a low speed. However, when the engine is sufficiently warmed up and the vehicle is started, the choking effect may be immediately eliminated in order to avoid exhaust gas pollution problems. Furthermore, the fast idling mechanism of the engine is not released so that stable engine idling may be provided. Moreover, problems of engine operation and exhaust gas pollution may be satisfactorily solved without modification of conventional automatic choke units. Since the movement of the diaphragm of the present invention is limited by the stopper means in order to prevent the choke valve from being moved to the fully opened position, undesirable or unnecessary forces are not applied to the choke valve or its shaft and a longer service life thereof may be ensured.

While a specific embodiment of the invention has been shown and described in detail to illustrate the application of the inventive principles, it will be understood that the invention may be embodied otherwise without departing from such principles.

What is claimed is:

1. An automatic choke system for an automotive vehicle internal combustion engine comprising a choke valve operable between a fully opened and a fully closed postion, temperature sensitive bimetallic spring means for controlling opening and closing of said choke valve, a choke control mechanism adapted to move said choke valve in the direction of opening to a limited position short of said fully opened position but proximate thereto, means for generating a first signal representative of the temperature of said engine, means for generating a second signal representative of the speed of said vehicle, and means for applying both said first and said second signals to said control mechanism to cause said choke valve to be opened to said limited position when the temperature of said engine and the speed of said vehicle reach predetermined levels, respectively, said control mechanism being arranged to permit independent operation of said bimetallic means beyond said limited position of said choke valve whereby said choke valve may be moved to said fully opened position by said bimetallic means when said engine has reached a fully warmed-up condition.

2. An automatic choke system for an automotive vehicle internal combustion engine comprising a choke valve operable between a fully opened and fully closed position, temperature sensitive bimetallic spring means for controlling opening and closing of said choke valve, a choke valve shaft, a lever fixed to said choke valve shaft, said lever having an elongated slot formed therein, a linkage member having a pair of ends, with one of said ends arranged for sliding engagement within said elongated slot, a diaphragm fixed to the other end of said linkage member, a diaphragm box including a diaphragm chamber and having said diaphragm disposed therein, a spring adapted to urge said diaphragm toward a position at which said one end of said linkage mechanism will slide within said elongated slot without actuating said lever, a stopper for limiting the stroke of said lever, said linkage member and said diaphragm, a vacuum pickup tube connected to an intake manifold of said engine, an atmospheric pressure pickup tube connected to a source of atmospheric pressure, a solenoid controlled valve adapted to selectively communicate either said negative pressure pickup tube or said atmospheric pressure pickup tube with said diaphragm chamber of said diaphragm box, a first switch actuatable in response to the temperature of said engine, a second switch actuatable in response to the speed of said vehicle, a power source and means connecting said first switch, said second switch and said power source in series through said solenoid controlled valve whereby said choke valve may be moved in the direction of opening to a limited position short of said fully opened position but proximate thereto in response to intake manifold vacuum applied in said diaphragm chamber when the vehicle speed and engine temperature reach predetermined levels.

3. A system according to claim 1 wherein said control mechanism includes diaphragm means connected to move said choke valve in response to pressure applied to said diaphragm means, and valve means responsive to said first and second signals for controlling the pressure applied to said diaphragm means.

4. A system according to claim 3 wherein said valve means are connected between said diaphragm means on one side thereof and the intake manifold of said engine and a source of atmospheric pressure on the other side thereof, said valve means operating to selectively apply to said diaphragm means either the pressure in said intake manifold or atmospheric pressure in response to said first and second signals.

5. An assembly according to claim 3 wherein said diaphragm means include stopper means limiting movement of said diaphragm means in one direction at a location corresponding to said limited position of said choke valve.

6. An assembly according to claim 3 including means interconnecting said diaphragm means with said choke valve, said interconnecting means being configured to effect movement of said choke valve in response to movement of said diaphragm means only in the direction of opening of said choke valve, with said choke valve being movable further in the direction of the opening thereof independently of said diaphragm means between said limited position and said fully opened position of said choke valve.

7. A system according to claim 6 wherein said interconnecting means include a linkage rod having a pair of ends with one of said ends connected to said diaphragm means, a lever mounted to rotate with said choke valve, and an elongated slot formed in said lever with the opposite end of said linkage rod being slidably engaged within said slot.

8. A system according to claim 3 wherein said valve means comprise a solenoid actuated valve, wherein said means for generating said first signal and said means for generating said second signal comprise, respectively, a first and second switch, and wherein said system includes a power source and means for connecting said power source, said solenoid actuated valve, and said first and second switches in a series circuit.

* * * * *